US008241145B2

(12) United States Patent
Hirsch et al.

(10) Patent No.: US 8,241,145 B2
(45) **Date of Patent: *Aug. 14, 2012**

(54) METAL INJECTION MOLDED PUTTER

(75) Inventors: Robert D. Hirsch, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/192,367

(22) Filed: Jul. 27, 2011

(65) Prior Publication Data

US 2011/0287858 A1 Nov. 24, 2011

Related U.S. Application Data

(63) Continuation of application No. 12/401,249, filed on Mar. 10, 2009, now Pat. No. 8,007,370.

(51) Int. Cl.
*A63B 53/04* (2006.01)

(52) U.S. Cl. ..... 473/349

(58) Field of Classification Search ..... 473/324–350
See application file for complete search history.

(56) References Cited

U.S. PATENT DOCUMENTS

| | | | | | |
|---|---|---|---|---|---|
| 5,338,024 | A * | 8/1994 | Baum | 264/510 |
| 5,342,812 | A * | 8/1994 | Niskanen et al. | 501/127 |
| 5,665,014 | A * | 9/1997 | Sanford et al. | 473/345 |
| 5,672,120 | A * | 9/1997 | Ramirez et al. | 473/347 |
| 5,690,879 | A * | 11/1997 | Lee | 264/237 |
| 5,985,208 | A * | 11/1999 | Zedalis et al. | 419/36 |
| 6,059,669 | A * | 5/2000 | Pearce | 473/339 |
| 6,093,116 | A * | 7/2000 | Hettinger et al. | 473/332 |
| 6,319,437 | B1 * | 11/2001 | Elsner et al. | 264/44 |
| 6,478,842 | B1 * | 11/2002 | Gressel et al. | 75/246 |
| 6,669,898 | B2 * | 12/2003 | Gressel et al. | 419/36 |
| 7,281,991 | B2 * | 10/2007 | Gilbert et al. | 473/342 |
| 7,303,489 | B2 * | 12/2007 | Gilbert et al. | 473/350 |
| 7,980,960 | B2 * | 7/2011 | Gilbert et al. | 473/290 |
| 8,007,370 | B2 * | 8/2011 | Hirsch et al. | 473/340 |

* cited by examiner

*Primary Examiner* — Alvin Hunter
(74) *Attorney, Agent, or Firm* — Mark S. Leonardo; Brown Rudnick LLP

(57) ABSTRACT

The present invention relates to a method for forming golf club head using metal injection molding and the resulting golf club head. The method of the invention allows for a lower volume of powdered metal than current metal injection molding processes thereby decreasing overall production cost.

20 Claims, 3 Drawing Sheets

METAL INJECTION MOLDED PUTTER

CROSS-REFERENCE TO RELATED APPLICATIONS

This application is a continuation of U.S. patent application Ser. No. 12/401,249, filed Mar. 10, 2009 and incorporated in its entirety by reference herein.

BACKGROUND OF THE INVENTION

1. Field of the Invention

The present invention relates to golf clubs formed by metal injection molding. More specifically, the present invention relates to putters formed by metal injection molding.

2. Description of the Related Art

Golf clubs are formed through a variety of methods. Commonly, a golf club head is forged or cast and then machined to the requisite dimensions and desired aesthetic quality. These processes have proven to be time consuming, inefficient, and expensive.

Recently, powdered injection molding has come to the forefront of golf club manufacturing. Metal injection molding or (MIM) is a manufacturing process which combines the versatility of plastic injection molding with the strength and integrity of machined, pressed or otherwise manufactured small, complex, metal parts. The process generally involves combining fine metal powders of a diameter of less than 45 micrometers with plastic binders (various thermoplastics, waxes, and other materials), which allow the metal to be injected into a mold using standard plastic injection molding machines.

After the part is molded and before the binders are removed, the post molding product is referred to as a "green part." The next step is to remove the binders and flow agents with solvents and thermal processes. The resultant metal part is then sintered at temperatures great enough to bind the particles but not melt the metal. This process results in a golf club that has a crisp, clean appearance similar to a golf club subjected to a milling process. However, this process requires powdered metals, which are expensive.

For example, U.S. Pat. No. 6,478,842 generally discloses a unitary golf club head made by metal injection molding. This requires that the entire volume of the club head is formed from powdered metal, which, as mentioned above, is cost prohibitive based on the cost of powdered metals.

Therefore, what is needed is a golf club that can be produced efficiently and with a low volume of powdered metal, while maintaining performance characteristics and aesthetic quality.

SUMMARY OF THE INVENTION

The present invention relates to methods of making a golf club head utilizing metal injection molding. In particular, the present invention relates to methods of forming putter type golf clubs. However, as would be appreciated by those of ordinary skill in the art, the present invention also relates to other types of golf club heads.

In one embodiment, a frame for the golf club head is composed of a first material. The first material may be composed of stainless steel, titanium, titanium alloys, tungsten alloys, aluminum alloys, or similar materials or combinations thereof. The frame is positioned into a mold where a combination of a powdered metal and a binding agent is injected into the mold and around the frame. The powdered metal is comprised of stainless steel, titanium, titanium alloys, tungsten alloys, aluminum alloys, similar materials, or combinations thereof. In addition, the powdered metal may be comprised of particles with an average diameter of less than about 40 micrometers. The binding agent may be water soluble. Optionally, a flow agent may also be added to the combination.

The molded product or "green part" is removed from the mold and washed with a solvent to remove the binding agent. The solvent may be water or another solvent specifically selected to remove the binding agent. The washed product is then subjected to a sintering process to further remove the binding agent and to fuse the metal particles together.

In another embodiment, the frame is positioned in a mold that is designed to include a void in the green part. The mold may be designed such that the green part contains a void of about 10 percent to about 75 percent of the total possible volume of the mold. The total possible volume of the mold is calculated using the outermost dimensions of the mold.

A combination of a powdered metal and a binding agent is then injected into the mold and around the frame. The powdered metal may be composed of stainless steel, titanium, titanium alloys, tungsten alloys, aluminum alloys, similar materials, or combinations thereof. In addition, the powdered metal may be composed of particles with an average diameter of less than about 40 micrometers. In one embodiment, the binding agent may be water soluble. A flow agent may also be added to the combination.

The green product is subjected to a solvent and a sintering process. After the sintering process, a second material may be added to fill the voids resulting from the mold design. The second material may be composed of an epoxy, thermoplastic, thermoset, loaded or impregnated polymer, bulk molding compound, or similar materials, or combinations thereof.

BRIEF DESCRIPTION OF THE DRAWINGS

Further features and advantages of the invention can be ascertained from the following detailed description that is provided in connection with the drawing(s) described below.

DETAILED DESCRIPTION OF THE PREFERRED EMBODIMENT

The present invention is directed to a process for forming a golf club using metal injection molding with an emphasis on reducing the cost and increasing the efficiency of the overall process. In particular, the process of the invention involves metal injection molding combined with the use of fillers, frames, or a combination thereof to produce an inexpensive and aesthetically pleasing golf club head.

For example, the metal injection molding process, which generally involves mixing fine metal powders with binders to form a feedstock that is injection molded into a closed mold, may be used to envelop a frame to form a golf club head. After ejection from the mold, the binders are chemically or thermally removed from the golf club head so that the part can be sintered to high density. During the sintering process, the individual metal particles metallurgically bond together as material diffusion occurs to remove most of the porosity left by the removal of the binder. The sintering process thus shrinks the part, providing a net shape that can be used as-is or further worked to add additional features or improve tolerances.

The present invention contemplates the use of the process for a variety of golf club heads and other golf club parts. In one embodiment, putter-type golf club heads are formed using the process of the invention.

Co-Molding

Figure 1:
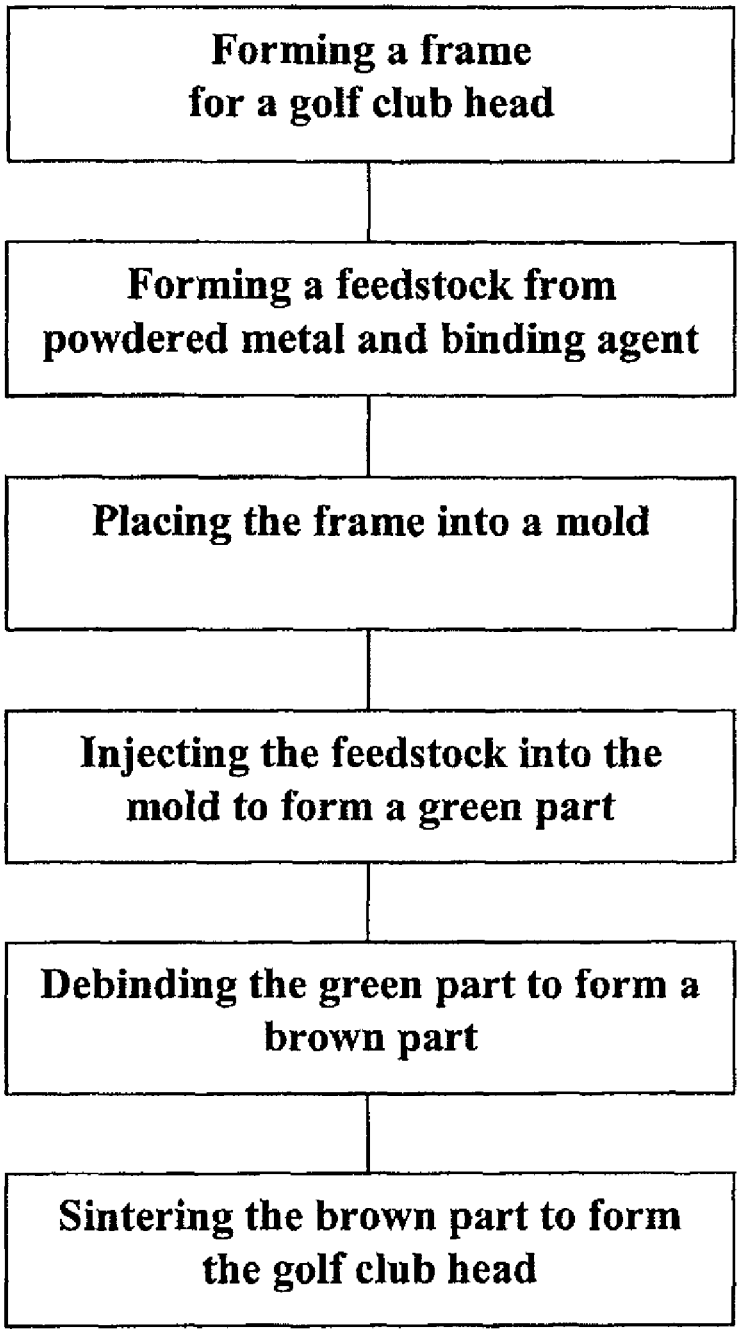
FIG. 1 is a block diagram of a process according to an embodiment of the invention.

In one embodiment, a co-molding process is used to form a club head (shown generally in FIG. 1). Initially, a frame or inner skeleton of the club head is formed through known methods. For example, the frame may be cast or forged. In addition, the frame can be made from any metal or metal alloy typically used to form golf clubs. Example metals for use as a frame include, but are not limited to, stainless steel, titanium, titanium alloys, tungsten alloys, aluminum alloys, or similar materials or combinations thereof. In one embodiment, the frame corresponds to a putter head.

The frame is then subjected to a metal injection molding process that adds a metallic body around the frame. In particular, the frame may be inserted into a mold where a feedstock of powdered metal and a binding agent are heated and injected into a closed mold surrounding the frame.

Feedstock in accordance with the present invention may be prepared by blending the powdered metal with the binder, and then heating the blend to form a slurry. Uniform dispersion of the powdered metal in the slurry may be achieved by employing high shear mixing. The slurry may then be cooled to ambient temperature and then granulated to provide the feedstock for the metal injection molding.

The amount of powdered metal and binder in the feedstock may be selected to optimize moldability while insuring acceptable green densities. In one embodiment, the feedstock used for the metal injection molding portion of the invention may include at least about 40 percent by weight powdered metal, preferably about 50 percent by weight powdered metal or more. In one embodiment, the feedstock includes at least about 60 percent by weight powdered metal, preferably about 65 percent by weight or more powdered metal. In yet another embodiment, the feedstock includes at least about 75 percent by weight powdered metal. The binder may be present in an amount of about 50 percent or less by weight of the feedstock. In one embodiment, the binder is present in an amount ranging from 25 percent to about 50 percent by weight. In another embodiment, the binder is present in an amount of about 30 percent to about 40 percent by weight of the feedstock.

Examples of suitable powdered metals for use in the feedstock include, but are not limited to: stainless steel including martensitic and austenitic stainless steel, steel alloys, tungsten alloys, soft magnetic alloys such as iron, iron-silicon, electrical steel, iron-nickel (50Ni-50F3), low thermal expansion alloys, or combinations thereof. In one embodiment, the powdered metal is a mixture of stainless steel and tungsten alloy.

As known to those of ordinary skill in the art, stainless steel is an alloy of iron and at least one other component that imparts corrosion resistance. As such, in one embodiment, the stainless steel is an alloy of iron and at least one of chromium, nickel, silicon, molybdenum, or mixtures thereof Examples of such alloys include, but are not limited to, an alloy containing about 1.5 to about 2.5 percent nickel, no more than about 0.5 percent molybdenum, no more than about 0.15 percent carbon, and the balance iron with a density ranging from about 7 g/cm$^3$ to about 8 g/cm$^3$; an alloy containing about 6 to about 8 percent nickel, no more than about 0.5 percent molybdenum, no more than about 0.15 percent carbon, and the balance iron with a density ranging from about 7 g/cm$^3$ to about 8 g/cm$^3$; an alloy containing about 0.5 to about 1 percent chromium, about 0.5 percent to about 1 percent nickel, no more than about 0.5 percent molybdenum, no more than about 0.2 percent carbon, and the balance iron with a density ranging from about 7 g/cm$^3$ to about 8 g/cm$^3$; an alloy containing about 2 to about 3 percent nickel, no more than about 0.5 percent molybdenum, about 0.3 to about 0.6 percent carbon, and the balance iron with a density ranging from about 7 g/cm$^3$ to about 8 g/cm$^3$; an alloy containing about 6 to about 8 percent nickel, no more than about 0.5 percent molybdenum, about 0.2 to about 0.5 percent carbon, and the balance iron with a density ranging from about 7 g/cm$^3$ to about 8 g/cm$^3$; an alloy containing about 1 to about 1.6 percent chromium, about 0.5 percent or less nickel, no more than about 0.5 percent molybdenum, about 0.9 to about 1.2 percent carbon, and the balance iron with a density ranging from about 7 g/cm$^3$ to about 8 g/cm$^3$; and combinations thereof.

Suitable tungsten alloys include an alloy containing about 2.5 to about 3.5 percent nickel, about 0.5 percent to about 2.5 percent copper or iron, and the balance tungsten with a density ranging from about 17.5 g/cm$^3$ to about 18.5 g/cm$^3$; about 3 to about 4 percent nickel, about 94 percent tungsten, and the balance copper or iron with a density ranging from about 17.5 g/cm$^3$ to about 18.5 g/cm$^3$; and mixtures thereof.

The particle size of the powdered metals for use in the feedstock may range from about 1 μm to about 45 μm. In one embodiment, the particle size is from about 1 μm to 30 μm in diameter. In another embodiment, the particle size is from about 1 μm to 20 μm in diameter.

The binding agent may be any suitable binding agent that does not destroy or interfere with the powdered metals. In one embodiment, the binder is an aqueous binder. In another embodiment, the binder is an organic-based binder to prevent reaction between the water present in an aqueous binder with the powdered metal if the feedstock is to be stored long periods before use. Examples of binders suitable for use with the present invention include; but are not limited to, thermoplastic resins, waxes, and combinations thereof. Non-limiting examples of thermoplastic resins include polyolefins such as acrylic polyethylene, polypropylene, polystyrene, polyvinyl chloride, polyethylene carbonate, polyethylene glycol, and mixtures thereof. Suitable waxes include, but are not limited to, microcrystalline wax, bee wax, synthetic wax, and combinations thereof.

In one embodiment, the binder is a combination of a high melting point thermoplastic resin and a low melting point oil or wax, such as the system disclosed in U.S. Pat. No. 4,765,950. This type of binder aids in preventing cracking of the green part during cooling.

The binders may also contain plasticizers, such as dioctyl phthalate, diethyl phthalate, di-n-batyl phthalate and diheptyl phthalate.

In addition, the binders may contain additives such as antioxidants, coupling agents, surfactants, elasticizing agents, dispersants, and lubricants as disclosed in U.S. Pat. No. 5,950,063, which is hereby incorporated by reference in its entirety. Suitable examples of antioxidants include, but are not limited to thermal stabilizers, metal deactivators, or combinations thereof. In one embodiment, the binder includes about 0.1 to about 2.5 percent by weight of the binder of an antioxidant. Coupling agents may include but are not limited to titanate, aluminate, silane, or combinations thereof. Typical levels range between 0.5 and 15% by weight of the binder.

Once the frame has been surrounded by the composition, the post molding product or "green part" is then removed from the mold and allowed to cool. The binders are then chemically or thermally removed. For example, the green part may be washed with a solvent to remove the binding agent. In one embodiment, the binding agent is water soluble and water is used as the solvent. In another embodiment, the binding agent is removed by thermal treatment at a temperature of about 300° C. or less. In one embodiment, the thermal treatment is conducted at a temperature of about 275° C. or less, preferably from about 200° C. to about 250° C.

The binder removal process may be a two-stage process. In particular, a portion of the binder may first be removed to open up a pore network within the green part. The remaining binder may then be subsequently removed through the open pore network that has been created. This two-stage process removes the binder without creating internal cracks or voids within the part. For example, in the case of a binder that includes a high melting point thermoplastic and a low melting point oil or wax, after the molded part is cooled, the lower melting point component is selectively dissolved leaving a porous structure from which the higher melting point component can be efficiently removed by thermal debinding. The resulting part is then referred to as a "brown part."

The brown part is then subjected to a sintering process at a temperature sufficient to remove any remaining binder, create metallurgical bonds between the metal particles, and cause densification. As would be understood by those of ordinary skill in the art, the temperature is dependent on the materials in the feedstock. In one embodiment, the sintering is carried out at temperatures ranging from about 1200° C. to about 1450° C. (about 2200° F. to about 2642° F.), preferably about 1260° C. to 1430° C. (about 2300° F. to 2600° F.) for a predetermined period of time. For example, the sintering process may be from about 35 minutes to about 2.5 hours. In one embodiment, the time is from about 45 minutes to about 2 hours. In another embodiment, the time is from about 55 minutes to about 1.75 hours. In still another embodiment, the time is from about 60 minutes to 1.5 hours.

The sintering process may be carried out in controlled atmosphere furnaces (sometimes in vacuum) at a temperature below the melting point of the metal. As such, the exact composition of the sintering atmosphere depends on the metal or metals being sintered. For example, in some cases, a straightforward atmosphere containing hydrogen is all that is required. Although the atmospheric conditions may vary for the particular materials present, a person skilled in the art of metal injection molding would be able to determine the correct atmospheric conditions for a particular material.

After sintering, any voids that may be present due to the design of the mold may be filled with a filling agent. Suitable filling agents include, but are not limited to, epoxies, thermoplastics, thermosets, loaded or impregnated polymers, bulk molding compounds, and combinations thereof.

The use of a frame in this aspect of the invention reduces the amount of powdered metal that is actually needed to form the club head, which, in turn, reduces the overall cost of the materials. In addition, the combination of a filling agent and a frame further reduces the amount of powdered metal that is needed to form the club head, which reduces the overall cost of the materials.

While the finished club head may be subjected to secondary operations such as heat treatment, machining, grinding, tumbling, polishing, milling, welding, or tooling to create more detail, the process of the invention does not require such additional steps because the shape complexity available with the process of the invention is improved over the prior methods to form a club head.

In fact, the sintering process results in a decrease in the volume of the club head. According to one embodiment, the sintering process results in less than about 20 percent volume loss. For example, the green part may "shrink" about 10 percent to about 20 percent from its original size during sintering to achieve final component density of about 90 to about 98 percent of full density, preferably about 96 to about 98 percent of full density. In one embodiment, the green part shrinks about 15 percent or less from its original size. In another embodiment, the green part shrinks about 12 percent or less from its original size as a result of sintering.

This size reduction is beneficial in the club head design. In particular, because the green part is formed from a mold that is actually about 20 percent larger than the final product, more detail may be incorporated into the part because of the larger initial size. This results in less need for detailed finishing work, which also typically adds to the manufacturing cost.

Pocketed Molds

The mold used for metal injection molding the club head according to the present invention may be designed to allow one or more pockets or voids to form in the green part. By filling the pockets or voids with a filling agent, the overall amount of powdered metal is reduced and, thus, the overall material and process costs can be reduced.

Figure 2:
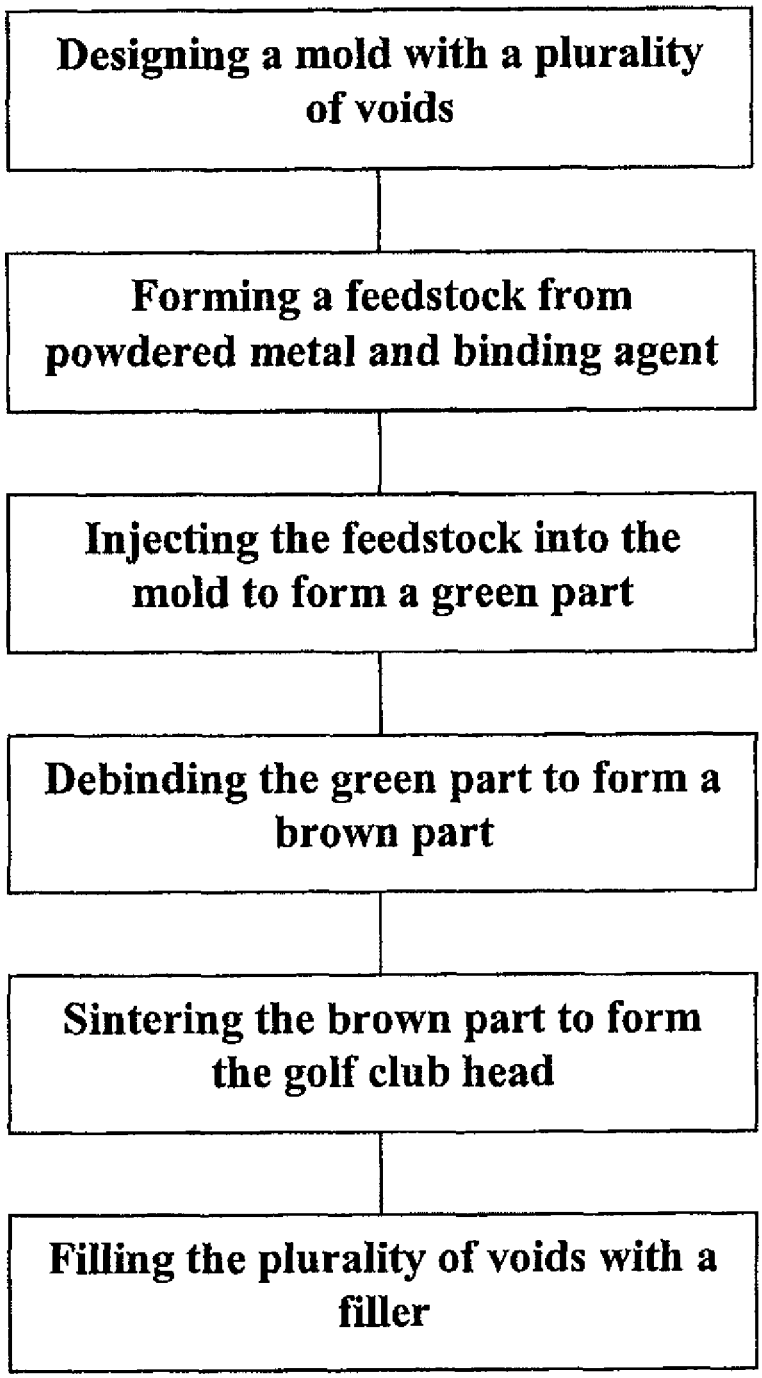
FIG. 2 is a block diagram of a process according to an embodiment of the invention.
Figure 3:
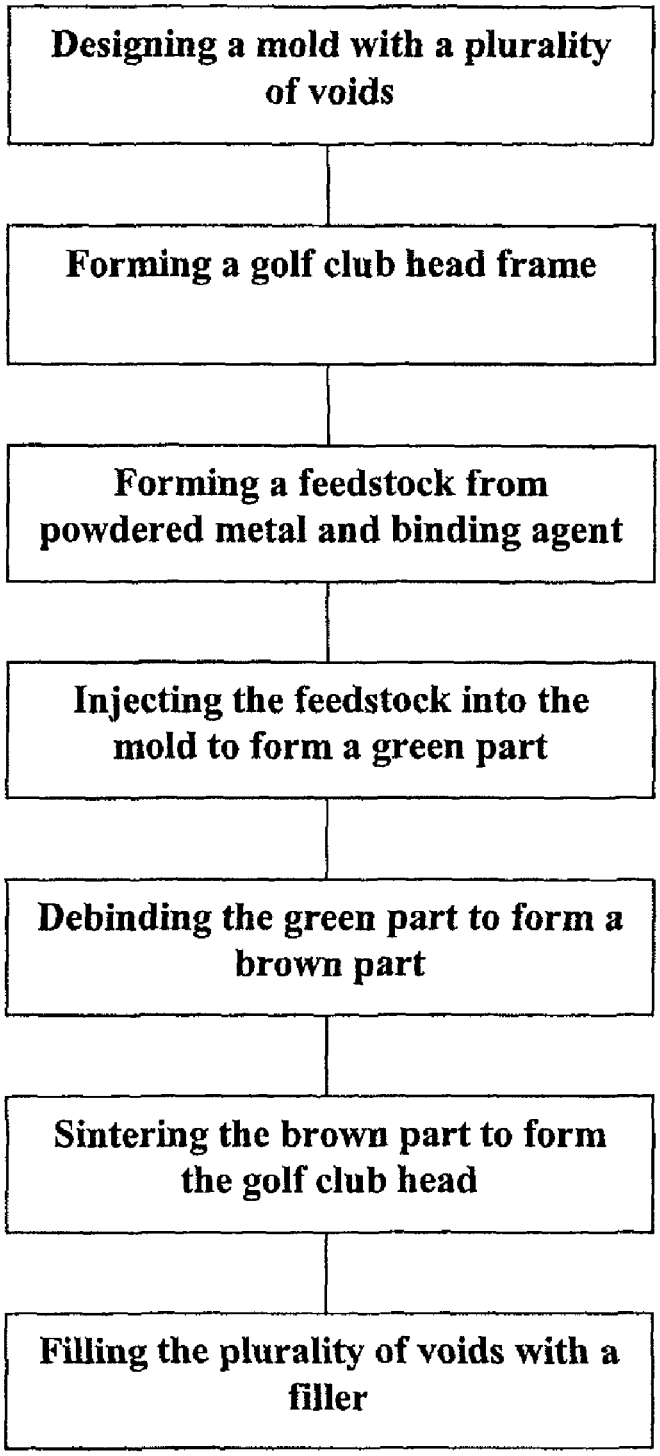
FIG. 3 is a block diagram of a process according to an embodiment of the invention.

This aspect of the invention may be used with or without the frame discussed previously. For example, in one embodiment, the process of the invention is directed to designing a mold that allows one or more voids to form in the green part and metal injection molding the club head. Such a mold may be used independently of the frame and metal injection molding process described above (shown generally in FIG. 2) or, in the alternatively, in combination with the frame and metal injection molding process (shown generally in FIG. 3).

In particular, the mold may be designed such that the resulting green part has about 10 percent to about 75 percent of the total possible volume of the mold as empty space. The total possible volume of the mold is calculated by using the outermost dimensions of the mold. In another embodiment, the volume of the empty space may be about 25 percent to about 60 percent of the total possible volume of the mold. Alternatively, the volume of the empty space may be about 40 percent to about 50 percent of the total possible volume of the mold.

For example, the mold may take any outermost shape. In one embodiment, the mold is rectangular in shape. The mold may also have one or more protrusions that take up space. When the green part is removed from the mold, the volume previously occupied by the protrusions in the mold will result in hollow areas in the green part.

The green part may then subjected to the same washing, binder removal and sintering processes as outlined in the previous embodiment.

As with the previously described embodiment, any post-sintering voids that may be present due to the design of the mold may be filled with a filling agent. Suitable filling agents include, but are not limited to, epoxies, thermoplastics, thermosets, loaded or impregnated polymers, bulk molding compound, and combinations thereof.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A method of making a golf club head comprising:

providing a frame comprising a first material;

positioning the frame in a mold; and injection molding a second material around the frame to form the golf club head;

wherein the mold is configured such that the golf club head has one or more voids and has about 10 percent to about 75 percent of the total possible volume of the mold as empty space.

2. The method of claim 1, wherein the mold is configured such that the golf club head has about 25 percent to about 60 percent of the total possible volume of the mold as empty space.

3. The method of claim 1, wherein the mold is configured such that the golf club head has about 40 percent to about 50 percent of the total possible volume of the mold as empty space.

4. The method of claim 1, wherein the first material comprises a metal.

5. The method of claim 1, wherein the first material comprises stainless steel, titanium, titanium alloys, tungsten alloys, aluminum alloys, or combination thereof.

6. The method of claim 1, wherein the frame is cast or forged.

7. The method of claim 1, wherein the second material comprises a powder metal.

8. The method of claim 7, wherein the powdered metal is selected from the group consisting of stainless steel, titanium, titanium alloys, tungsten alloys, aluminum alloys, or combinations thereof.

9. The method of claim 7, wherein the powdered metal is selected from the group consisting of stainless steel, titanium, titanium alloys, tungsten alloys, aluminum alloys, or combinations thereof.

10. The method of claim 1, wherein the second material comprises a binding agent.

11. The method of claim 1, wherein the second material comprises a thermoplastic resin.

12. The method of claim 1, wherein the second material comprises a filling agent.

13. The method of claim 1, wherein the second material comprises an epoxy, a thermoplastic polymer, a thermoset polymer, an impregnated polymer, a bulk molding compound, or a combination thereof.

14. A golf club head comprising:

an inner frame comprising a first material; and an outer shell comprising a second material;

wherein the golf club head comprises one or more voids comprising about 10 percent to about 75 percent of the total possible volume of the golf club head.

15. The method of claim 1, wherein the first material comprises a metal.

16. The method of claim 1, wherein the second material comprises a powder metal.

17. The method of claim 1, wherein the second material comprises a binding agent.

18. The method of claim 1, wherein the second material comprises a thermoplastic resin.

19. The method of claim 1, wherein the second material comprises a filling agent.

20. The method of claim 1, wherein the second material comprises an epoxy, a thermoplastic polymer, a thermoset polymer, an impregnated polymer, a bulk molding compound, or a combination thereof.

* * * * *